US010785563B1

(12) United States Patent
Kawata

(10) Patent No.: US 10,785,563 B1
(45) Date of Patent: Sep. 22, 2020

(54) OMNI-DIRECTIONAL AUDIBLE NOISE SOURCE LOCALIZATION APPARATUS

(71) Applicant: Hitachi, Ltd., Chiyoda-ku, Tokyo (JP)

(72) Inventor: Hiroshi Kawata, Novi, MI (US)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 16/355,461

(22) Filed: Mar. 15, 2019

(51) Int. Cl.

| | |
|---|---|
| ***H04R 3/00*** | (2006.01) |
| ***H04R 5/027*** | (2006.01) |
| ***H04S 3/02*** | (2006.01) |
| ***H04R 5/04*** | (2006.01) |

(52) U.S. Cl.
CPC ..... *H04R 3/005* (2013.01); *H04R 5/027* (2013.01); *H04R 5/04* (2013.01); *H04S 3/02* (2013.01); *H04S 2420/11* (2013.01)

(58) Field of Classification Search
CPC .. H04R 3/005; H04R 5/07; H04R 5/04; H04S 3/02; H04S 2420/11
USPC ..... 381/91, 92, 122; 463/35; 396/361; 348/37, 38, 231.4
See application file for complete search history.

(56) References Cited

U.S. PATENT DOCUMENTS

| | | | | |
|---|---|---|---|---|
| 8,183,997 | B1 * | 5/2012 | Wong | G01S 3/8036 340/539.11 |
| 8,229,134 | B2 * | 7/2012 | Duraiswami | H04R 1/406 348/462 |
| 8,403,751 | B2 * | 3/2013 | Boustead | A63F 13/12 463/35 |
| 9,668,077 | B2 * | 5/2017 | Tico | H04R 3/005 |
| 10,158,939 | B2 * | 12/2018 | Mannion | H04R 1/406 |
| 10,425,610 | B2 * | 9/2019 | Jing | H04N 5/607 |
| 2009/0214046 | A1 * | 8/2009 | Suzuki | H04S 7/301 381/17 |
| 2015/0237455 | A1 * | 8/2015 | Mitra | H04N 7/183 381/92 |
| 2015/0301592 | A1 | 10/2015 | Miller | |
| 2015/0325226 | A1 | 11/2015 | Rosedale et al. | |
| 2017/0311080 | A1 * | 10/2017 | Kolb | H04R 1/342 |
| 2018/0306890 | A1 * | 10/2018 | Vatcher | G01S 3/86 |
| 2019/0341053 | A1 * | 11/2019 | Zhang | G10L 17/005 |

* cited by examiner

*Primary Examiner* — Xu Mei
(74) *Attorney, Agent, or Firm* — Procopio, Cory, Hargreaves & Savitch LLP

(57) ABSTRACT

Systems and methods for an equipment capable of simultaneous measurements of surround sound reproduction and noise source localization in closed or open space. The systems and methods are particularly used when surround sound reproduction and noise source localization are required in a moving object of a closed space. A moving object in a closed space is not limited to a specific product, as for example, an automobile, a train, an elevator, or the like can be considered.

15 Claims, 6 Drawing Sheets

OMNI-DIRECTIONAL AUDIBLE NOISE SOURCE LOCALIZATION APPARATUS

BACKGROUND

Field

The present disclosure relates generally to sound systems, and more specifically to systems and methods for providing three-dimensional sound for three dimensional video.

Related Art

In the related art, sound (noise) problems for products have been difficult to share between developers and customers. This is because sound is a sensory evaluation and cannot generally be shared unless developers and customers are in the same situation (e.g., position, environmental conditions) to hear the particular sound.

In related art implementations, surround sound technology have been developed for reproducing the three dimensional sound direction and spread when recording and reproducing the sound. Surround sound can be reproduced with special microphones. Such related art implementations are expected to promote information sharing with product developers and customers.

In related art implementations, there are virtual reality (VR) that are configured to produce three dimensional audio, however, such related art implementations do not provide any means for conducting actual recording of audio nor do they provide any implementations for noise source localization. Generally, even in related art implementations involving surround sound reproduction method, there is no description about noise source localization or recording for such noise source localization.

SUMMARY

Related art implementations do not conduct any noise source localization, which is a requirement to determine the sound (noise) problem for a given environment. Related art implementations have utilized the evaluation by a sound pressure level (magnitude) typified by an acoustic camera. However, an enclosed space such as a closed room becomes a very complicated sound field due to the interference involving multiple sound waves. In particular, in a moving object such as a car or a train, the noise in the surrounding environment, such as outside noise and air conditioning noise are large even before the moving object begins to move. It can be difficult to clearly divide the noise of the environment while the object is in motion from the other noise at the sound pressure level.

Example implementations described herein involve a moving object, and more particularly to a method of searching for one or more noise sources from a microphone capable of recording sound from all directions in the object.

Aspects of the present disclosure can involve a system, which involves a microphone array involving at least four microphones arranged along locations with respect to each other in a three dimensional shape; a 360 degree camera; and a processor, configured to, for audio received through the microphone array, calculate three dimensional sound intensity between two of the at least four microphones of the microphone array; and overlay the audio on video feed of the 360 degree camera with the three dimensional sound intensity with respect to a displayed view of the video feed.

Aspects of the present disclosure can include a method for a system involving a microphone array involving at least four microphones arranged along locations with respect to each other in a three dimensional shape, and a 360 degree camera; the method involving for sound received through the microphone array, calculating three dimensional sound intensity between two of the at least four microphones of the microphone array; and overlaying the video feed of the 360 degree camera with the three dimensional sound intensity with respect to a displayed view of the video feed.

Aspects of the present disclosure can include a computer program, storing instructions for a system involving a microphone array involving at least four microphones arranged along locations with respect to each other in a three dimensional shape, and a 360 degree camera; the instructions involving for sound received through the microphone array, calculating three dimensional sound intensity between two of the at least four microphones of the microphone array; and overlaying the video feed of the 360 degree camera with the three dimensional sound intensity with respect to a displayed view of the video feed. The instructions can be stored in a non-transitory computer readable medium.

Aspects of the present disclosure can involve an apparatus connected to a microphone array involving at least four microphones arranged along locations with respect to each other in a three dimensional shape, and to a 360 degree camera; the apparatus involving a processor, configured to, for sound received through the microphone array, calculate three dimensional sound intensity between two of the at least four microphones of the microphone array; and overlay the video feed of the 360 degree camera with the three dimensional sound intensity with respect to a displayed view of the video feed.

Aspects of the present disclosure can involve a system, which involves a microphone array involving at least four microphones arranged along locations with respect to each other in a three dimensional shape; a 360 degree camera; and a processor, configured to, for audio received through the microphone array, calculate three dimensional sound intensity between two of the at least four microphones of the microphone array; and overlay the video feed of the 360 degree camera with the three dimensional sound intensity with respect to a displayed view of the video feed.

DETAILED DESCRIPTION

Figure 1:
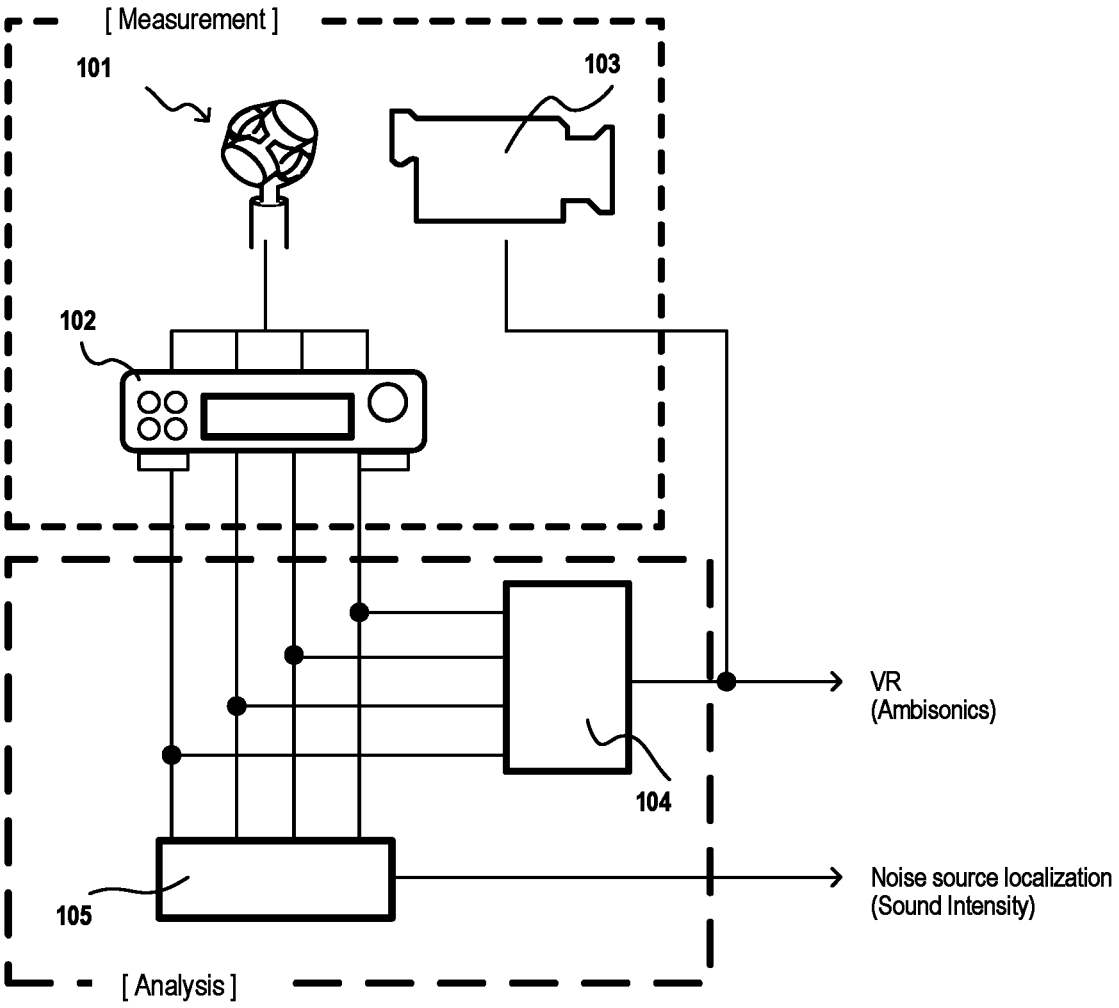
FIG. 1 is a system outline of an apparatus, in accordance with an example implementation.

The following detailed description provides further details of the figures and example implementations of the present application. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or administrator control over certain aspects of the implementation, depending on the desired implementation of one of ordinary skill in the art practicing implementations of the present application. Selection can be conducted by a user through a user interface or other input means, or can be implemented through a desired algorithm. Example implementations as described herein can be utilized either singularly or in combination and the functionality of the example implementations can be implemented through any means according to the desired implementations.

Example implementations described herein involve systems and methods for an equipment capable of simultaneous measurements of surround sound reproduction and noise source localization in closed or open space. The systems and methods are particularly used when surround sound reproduction and noise source localization are required in a moving object of a closed space. A moving object in a closed space is not limited to a specific product, as for example, an automobile, a train, an elevator, or the like can be considered.

For noise source localization, example implementations focus on the sound intensity indicating the amount and direction of the acoustic energy flow. Since sound intensity is not easily influenced by background noise, example implementations described herein can utilize sound intensity to localize the noise source in a room involving a moving object despite having loud background noise.

In example implementations, sound intensity can be calculated by measuring the sound pressures of a plurality of microphones and the distance between the microphones.

In example implementations described herein, a special microphone used for surround sound pickup is utilized for an evaluation point microphone, wherein the acoustic intensity is calculated from the measured sound pressure and the distance between the microphones wherein the omnidirectional noise source can thereby be localized. With such example implementations, surround sound reproduction and noise source localization can thereby be performed at the same time.

According to the example implementations described herein, it is thereby possible not to be influenced by background noise for a moving object, and it is also possible to perform surround sound reproduction in all directions at the same time without indirectly bringing in measurement equipment for noise source localization measurement.

Hereinafter, example implementations of an omnidirectional audible noise source localization apparatus will be described with reference to the drawings.

FIG. 1 is a system outline of an apparatus, in accordance with an example implementation. In the example of FIG. 1, the measurement aspect of the apparatus involves a special microphone herein referred to as an ambisonics microphone 101, a sound recording device 102, and a video recording device 103 configured to conduct omnidirectional shooting. The analysis aspect of the apparatus involves a converter 104 for converting the sound picked up by the ambisonics microphone 101 for VR ambisonics reproduction, and a calculator 105 for calculating the sound intensity.

Figure 2:
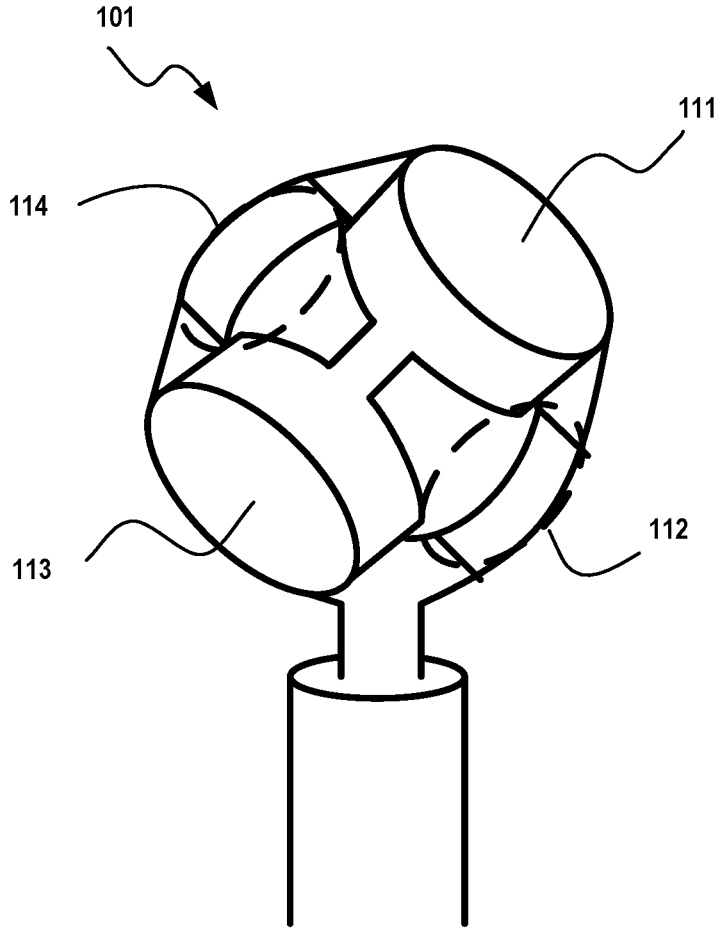
FIG. 2 is an example front view of the microphones portion of the ambisonics microphone, in accordance with an example implementation.

FIG. 2 is an example front view of the microphones portion of the ambisonics microphone 101, in accordance with an example implementation. There are four microphone capsules 111, 112, 113, 114, with the microphones facing outward from each face of a regular tetrahedron. Surround sound reproduction, or ambisonics, is possible by developing the spherical harmonic function of the signals picked up by the four microphone capsules (111 to 114) by the converter 104.

For using the microphone arrangement described herein, example implementations further involve systems and methods for calculating the sound intensity from the signal of the above ambisonics microphone 101, and conduct noise source localization from the calculation. Specifically, example implementations involve two methods of the operator 105 for calculating the sound intensity, the direct method and the cross spectrum method. Either method can be utilized in accordance with the desired implementation.

In a first example implementation, the direct method is utilized for calculating the sound intensity as described below.

Figure 3:
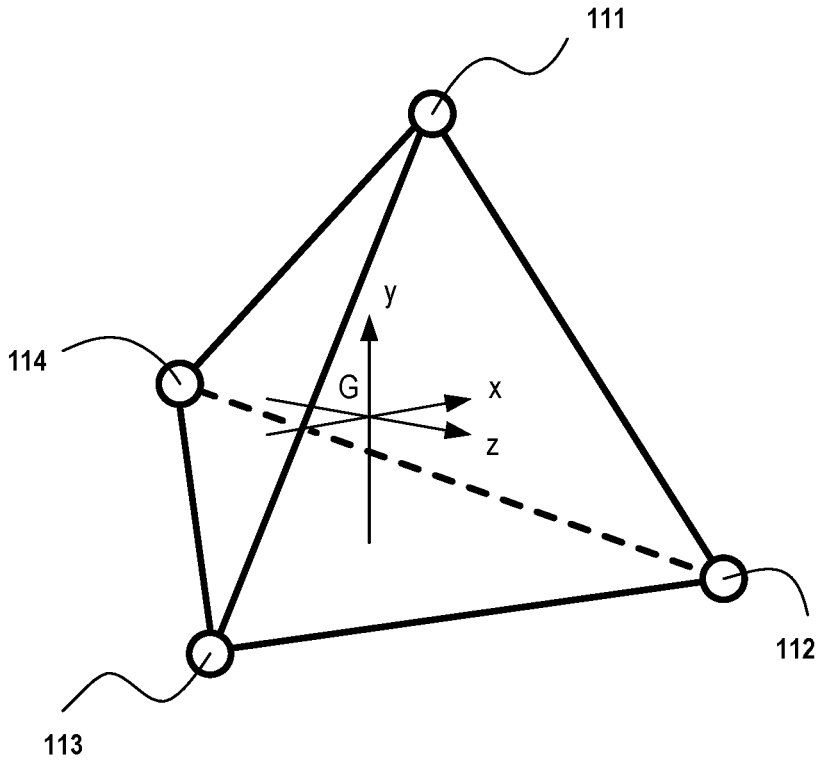
FIG. 3 illustrates an example arrangement of microphone capsules and coordinate axes, in accordance with an example implementation.

FIG. 3 illustrates an example arrangement of microphone capsules (111 to 114) and coordinate axes, in accordance with an example implementation. Each microphone capsules (111 to 114) are arranged at the vertexes of the regular tetrahedron. The center of gravity G of the regular tetrahedron is the acoustic center, and x, y, and z-axis coordinates are defined as shown in FIG. 3 with the acoustic center as the origin.

First, the sound pressure p0($t$) at the acoustic center is measured by each microphone and given as the average of the sound pressures p1($t$) to p4($t$)

$$p0(t) = \frac{1}{4}\sum_{i=1}^{4} pi(t) \quad \text{(Equation 1)}$$

When p0($t$) is used, if a sound wave is approximated by a plane wave at the distance Δr from the acoustic center to each microphone, the particle velocity ui(t) in the direction of each microphone from the acoustic center can be obtained by the following equation.

$$ui(t) = -\frac{1}{\rho\Delta r}\int\{pi(t) - p0(t)\}dt \quad \text{(Equation 2)}$$

Where ρ is the density of the propagation medium.

On the other hand, considering the geometrical conditions of the tetrahedron, the following relations exist between the particle velocity ui(t) and particle velocity components ux(t), uy(t), uz(t) in the x-, y-, and z-axis directions.

$$u1(t) = \frac{2\sqrt{2}}{3}uy(t) + \frac{1}{3}uz(t) \quad \text{(Equation 3)}$$

$$u2(t) = \frac{\sqrt{2}}{3}ux(t) - \frac{\sqrt{2}}{3}uy(t) + \frac{1}{3}uz(t) \quad \text{(Equation 4)}$$

$$u3(t) = -\frac{\sqrt{2}}{\sqrt{3}}ux(t) - \frac{\sqrt{2}}{3}uy(t) + \frac{1}{3}uz(t) \quad \text{(Equation 5)}$$

$$u4(t) = -uz(t) \quad \text{(Equation 6)}$$

From these equations (Equation 3 to 6), the particle velocity components in the x, y, z axis directions are derived as follows.

$$ux(t) = -\frac{\sqrt{3}}{2\sqrt{2}}\{u2(t) - u3(t)\} \quad \text{(Equation 7)}$$

$$uy(t) = -\frac{1}{2\sqrt{2}}\{2u1(t) - u2(t) - u3(t)\} \quad \text{(Equation 8)}$$

$$uz(t) = -\frac{1}{4}\{u1(t) + u2(t) + u3(t) - 3u4(t)\} \quad \text{(Equation 9)}$$

The sound intensity can be obtained by the time average of the product of sound pressure and particle velocity. In other words, from Equations 1, 2 and Equations 7-9, it is possible to measure three-dimensional sound intensity by measuring the sound pressure with four microphone capsules (111 to 114). Since the method as described can be utilized in real time processing, the measurement can be performed while watching the display at the site or the like.

In a second example implementation, the cross spectral method is utilized to measure three-dimensional sound intensity as follows. In this method, (Equation 2) is displayed in the frequency domain and the sound intensity I(x) is calculated approximately by the following equation which is processed.

$$I(x) = -\frac{1}{2\pi\rho\Delta x}\int_{-\infty}^{+\infty}\frac{\mathrm{Im}\{G_{12}(x,\omega)\}}{\omega}d\omega \quad \text{(Equation 10)}$$

Where $G_{12}(x,\omega)$ is the cross spectral function of the sound pressures p1($t$) and p2($t$) measured by the two microphones, and Im{ } is the imaginary part. In other words, the imaginary part of the cross spectrum of the sound pressure measured by the two microphones is the inverse Fourier transform. Since the cross spectrum is obtained from the Fourier transform of the sound pressure, this method can thereby correct the difference in sensitivity and phase characteristics of each microphone.

From the above example implementation, it is possible to calculate the sound intensity using the ambisonics microphone 101 and to search for the noise source localization in all directions. Therefore, example implementations make it possible to perform surround sound reproduction and noise source localization at the same time by using the ambisonics microphone 101.

Figure 4:
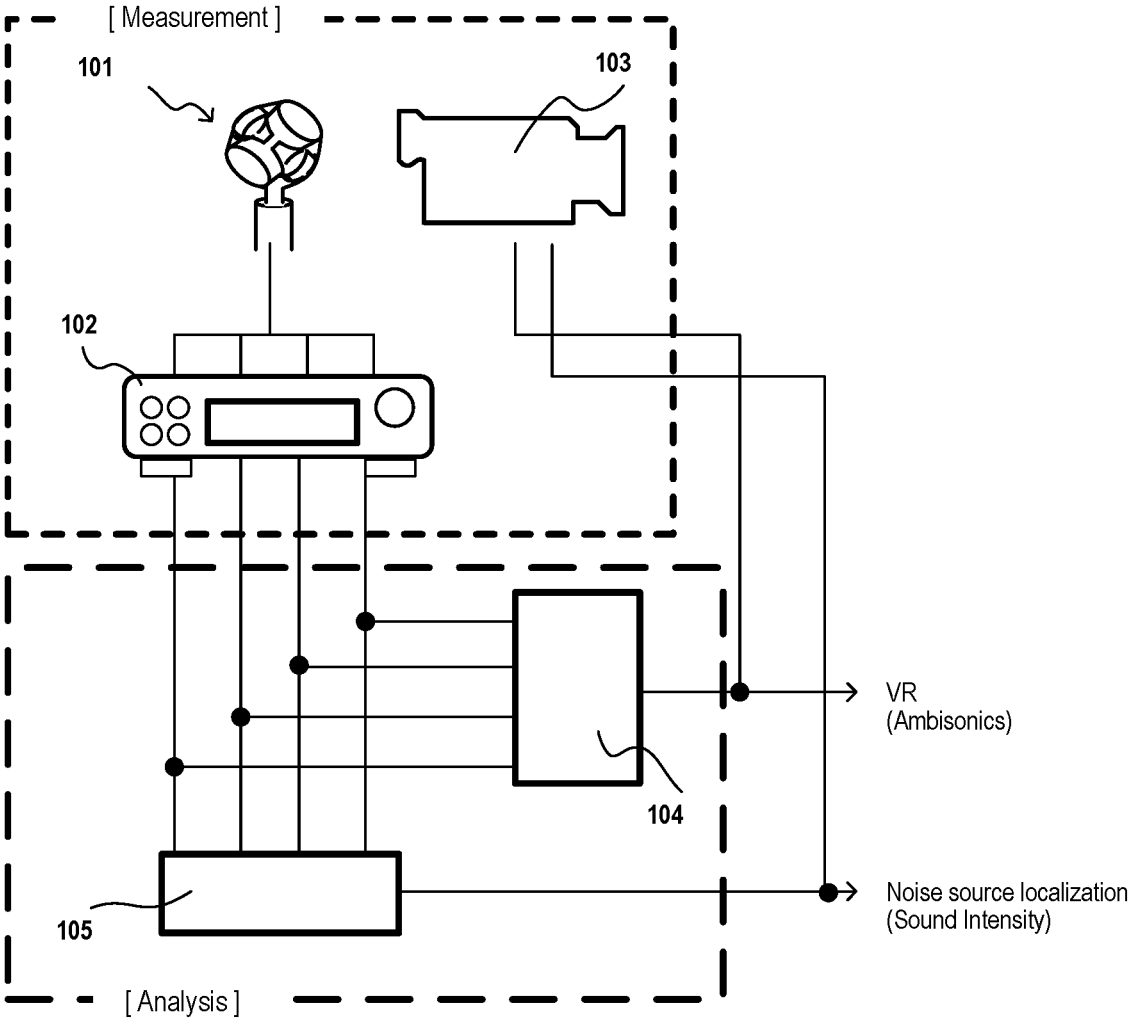
FIG. 4 illustrates an example system involving omnidirectional images, in accordance with an example implementation.

FIG. 4 illustrates an example system involving omnidirectional images, in accordance with an example implementation. As shown in FIG. 4, the noise source localization may be performed visually using omnidirectional images. Also, as long as the ambisonics microphone 101 can conduct measurements at the same time, the four microphones may be separate, but the apex position of the microphone should be on the regular tetrahedron to facilitate the example implementations described herein. However, depending on the desired implementation, other shapes besides a tetrahedron can be utilized so long as the sound intensity can be calculated based on the measurements made between two microphones within the microphone array. In such implementations, the equations as described herein should be adjusted to measure sound intensity between two microphones in accordance with the shape as used.

Further, multiple microphone arrays may be utilized in accordance with a desired implementation along with multiple cameras. In an example implementation, multiple instantiations of the system can be provided in each room in a building and utilized as a surveillance system in which the audio and video feed between the instantiations can be switched in accordance with the desired implementation.

Figure 5:
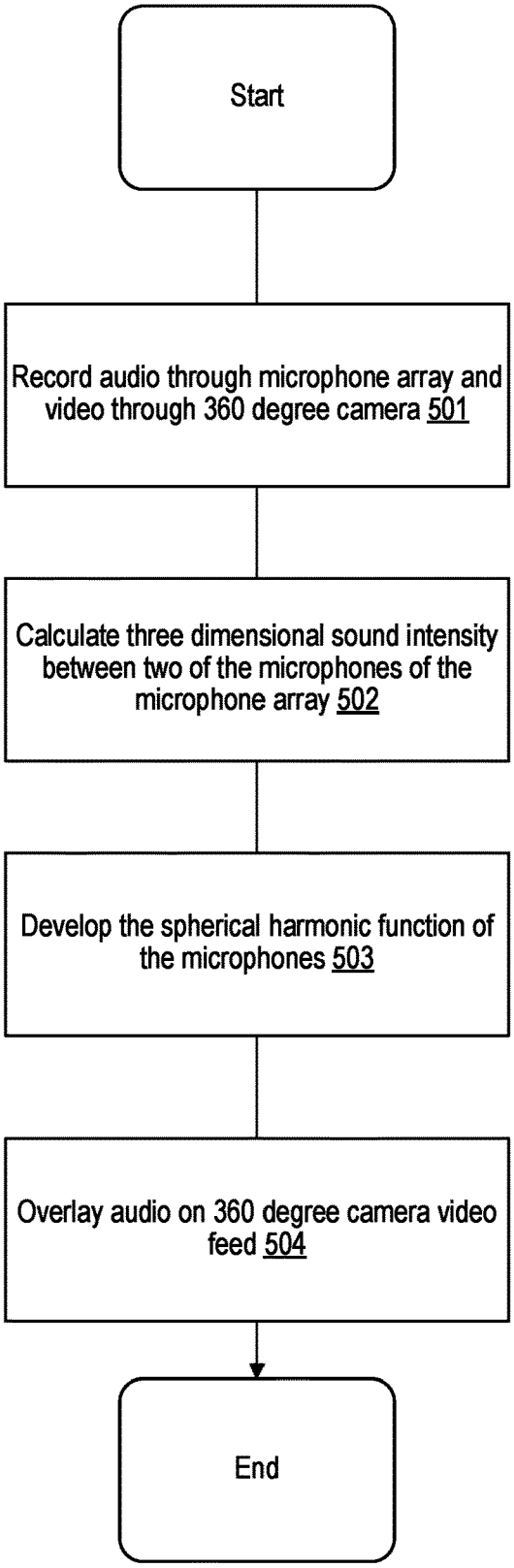
FIG. 5 illustrates an example flow for the device, in accordance with an example implementation.

FIG. 5 illustrates an example flow for the device, in accordance with an example implementation. At 501, the system as illustrated in FIG. 1 and FIG. 4 record sound through the microphone array and video through a 360 degree camera. At 502, the three dimensional sound intensity between the microphones of the microphone array is calculated in accordance with the implementations described, for example, with respect to the equations provided herein. At 503, the spherical harmonic function of the microphones signal is developed and a sound for surround sound reproduction is created. At 504, the surround sound is overlaid onto the video feed, wherein the surround sound can be played with respect to the point of view that is displayed from the video feed with the appropriate three dimensional sound intensity. From such an example implementation, a user can navigate the video feed on an interface in a 360 degree manner and then identify and locate the source of the sound on the interface with respect to the video feed. In an example implementation, the audio can be overlaid on the video feed with a heat map indicator on the video feed to indicate the location of the source of the audio based on the calculated sound intensity. For example, in the case where the object to be measured is in a steady state, an omnidirectional picture may be used as a substitute for the omnidirectional video.

Figure 6:
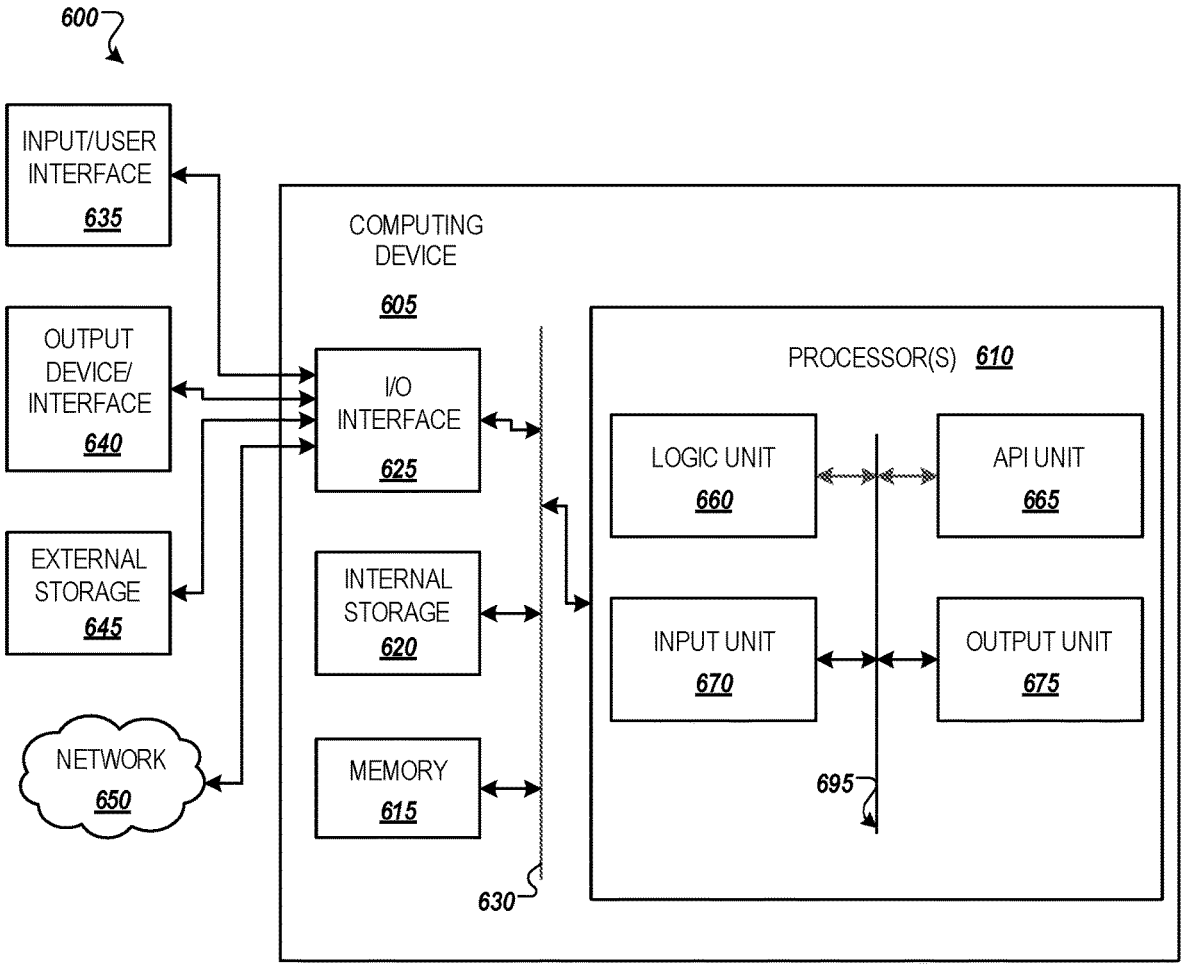
FIG. 6 illustrates an example computing environment with an example computer device suitable for use in example implementations.

FIG. 6 illustrates an example computing environment with an example computer device suitable for use in example implementations, such as a sound recording device or apparatus as illustrated in the system of FIGS. 1 and 4. Computer device 605 in computing environment 600 can include one or more processing units, cores, or processors 610, memory 615 (e.g., RAM, ROM, and/or the like), internal storage 620 (e.g., magnetic, optical, solid state storage, and/or organic), and/or I/O interface 625, any of which can be coupled on a communication mechanism or bus 630 for communicating information or embedded in the computer device 605.

Computer device 605 can be communicatively coupled to input/user interface 635 and output device/interface 640. Either one or both of input/user interface 635 and output device/interface 640 can be a wired or wireless interface and can be detachable. Input/user interface 635 may include any device, component, sensor, or interface, physical or virtual, that can be used to provide input (e.g., buttons, touch-screen interface, keyboard, a pointing/cursor control, microphone, camera, braille, motion sensor, optical reader, and/or the like). Output device/interface 640 may include a display, television, monitor, printer, speaker, braille, or the like. In some example implementations, input/user interface 635 and output device/interface 640 can be embedded with or physically coupled to the computer device 605. In other example implementations, other computer devices may function as or provide the functions of input/user interface 635 and output device/interface 640 for a computer device 605. In example implementations involving a touch screen display, a television display, or any other form of display, the display is configured to provide a user interface.

Examples of computer device 605 may include, but are not limited to, highly mobile devices (e.g., smartphones, devices in vehicles and other machines, devices carried by humans and animals, and the like), mobile devices (e.g., tablets, notebooks, laptops, personal computers, portable televisions, radios, and the like), and devices not designed for mobility (e.g., desktop computers, other computers, information kiosks, televisions with one or more processors embedded therein and/or coupled thereto, radios, and the like).

Computer device 605 can be communicatively coupled (e.g., via I/O interface 625) to external storage 645 and network 650 for communicating with any number of networked components, devices, and systems, including one or more computer devices of the same or different configuration. Computer device 605 or any connected computer device can be functioning as, providing services of, or referred to as a server, client, thin server, general machine, special-purpose machine, or another label.

I/O interface 625 can include, but is not limited to, wired and/or wireless interfaces using any communication or I/O protocols or standards (e.g., Ethernet, 802.11x, Universal System Bus, WiMax, modem, a cellular network protocol, and the like) for communicating information to and/or from at least all the connected components, devices, and network in computing environment 600. Network 650 can be any network or combination of networks (e.g., the Internet, local area network, wide area network, a telephonic network, a cellular network, satellite network, and the like).

Computer device 605 can use and/or communicate using computer-usable or computer-readable media, including transitory media and non-transitory media. Transitory media include transmission media (e.g., metal cables, fiber optics), signals, carrier waves, and the like. Non-transitory media include magnetic media (e.g., disks and tapes), optical media (e.g., CD ROM, digital video disks, Blu-ray disks), solid state media (e.g., RAM, ROM, flash memory, solid-state storage), and other non-volatile storage or memory.

Computer device 605 can be used to implement techniques, methods, applications, processes, or computer-executable instructions in some example computing environments. Computer-executable instructions can be retrieved from transitory media, and stored on and retrieved from non-transitory media. The executable instructions can originate from one or more of any programming, scripting, and machine languages (e.g., C, C++, C #, Java, Visual Basic, Python, Perl, JavaScript, and others).

Processor(s) 610 can execute under any operating system (OS) (not shown), in a native or virtual environment. One or more applications can be deployed that include logic unit 660, application programming interface (API) unit 665, input unit 670, output unit 675, and inter-unit communication mechanism 695 for the different units to communicate with each other, with the OS, and with other applications (not shown). The described units and elements can be varied in design, function, configuration, or implementation and are not limited to the descriptions provided. Processor(s) 610 can be in the form of physical processors or central processing units (CPU) that is configured to execute instructions loaded from Memory 615.

In some example implementations, when information or an execution instruction is received by API unit 665, it may be communicated to one or more other units (e.g., logic unit 660, input unit 670, output unit 675). In some instances, logic unit 660 may be configured to control the information flow among the units and direct the services provided by API unit 665, input unit 670, output unit 675, in some example implementations described above. For example, the flow of one or more processes or implementations may be controlled by logic unit 660 alone or in conjunction with API unit 665. The input unit 670 may be configured to obtain input for the calculations described in the example implementations, and the output unit 675 may be configured to provide output based on the calculations described in example implementations.

Processor(s) 610 may be configured to execute the flow of FIG. 5 to facilitate functionality for the systems as illustrated in FIGS. 1 and 4. Such a system can involve a microphone array involving at least four microphones arranged along locations with respect to each other in a three dimensional shape as illustrated in FIGS. 2 and 3 and a 360 degree camera.

In an example implementation, processor(s) 610 can be configured to for audio received through the microphone array, calculate three dimensional sound intensity between at least two of the at least four microphones of the microphone array; and overlay the audio on video feed of the 360 degree camera with the three dimensional sound intensity with respect to a displayed view of the video feed as illustrated in FIG. 5 and as described with respect to FIGS. 1-5.

As illustrated in FIG. 3, the three dimensional shape arrangement can be a regular tetrahedron.

As illustrated in FIGS. 3 and 4 and with respect to their corresponding description, processor(s) 610 can be configured to calculate the three dimensional sound intensity between the at least two of the at least four microphones of the microphone array by calculating the three dimensional sound intensity based on an inverse Fourier transform of a cross spectrum of the sound pressure measured by the at least two of the at least four microphones.

As illustrated in FIGS. 1 and 2 and with respect to their corresponding description, processor(s) 610 can be configured to calculate the three dimensional sound intensity between the at least two of the at least four microphones of the microphone array by calculating a sound pressure of an acoustic center of the microphone array; deriving a particle velocity between each of the at least four microphones of the microphone array and the acoustic center; and calculating the three dimensional sound intensity from particle velocity calculations along an x, y and z axis based on the derived velocity between the each of the at least four microphones of the microphone array and the acoustic center.

Depending on the desired implementation, the microphone array can be an ambisonics microphone consisting of four microphones as illustrated in FIG. 2.

Processor(s) 610 can also be configured to overlay the audio on the video feed of the 360 degree camera with the three dimensional sound intensity with respect to a displayed view of the video feed through a heat map representation of the three dimensional sound intensity on the video feed. Depending on the desired implementation, the heat map can be in the form of a color intensity (e.g., yellow to red) or grey scale intensity based on the calculated sound intensity, which can provide an indicator on the video feed as to the location source of the sound. Other heat map representations can be utilized in accordance with the desired implementation, and the present disclosure is not limited to any particular heat map representation.

Some portions of the detailed description are presented in terms of algorithms and symbolic representations of operations within a computer. These algorithmic descriptions and symbolic representations are the means used by those skilled in the data processing arts to convey the essence of their innovations to others skilled in the art. An algorithm is a series of defined steps leading to a desired end state or result. In example implementations, the steps carried out require physical manipulations of tangible quantities for achieving a tangible result.

Unless specifically stated otherwise, as apparent from the discussion, it is appreciated that throughout the description, discussions utilizing terms such as "processing," "computing," "calculating," "determining," "displaying," or the like, can include the actions and processes of a computer system or other information processing device that manipulates and transforms data represented as physical (electronic) quantities within the computer system's registers and memories into other data similarly represented as physical quantities within the computer system's memories or registers or other information storage, transmission or display devices.

Example implementations may also relate to an apparatus for performing the operations herein. This apparatus may be specially constructed for the required purposes, or it may include one or more general-purpose computers selectively activated or reconfigured by one or more computer programs. Such computer programs may be stored in a computer readable medium, such as a computer-readable storage medium or a computer-readable signal medium. A computer-readable storage medium may involve tangible mediums such as, but not limited to optical disks, magnetic disks, read-only memories, random access memories, solid state devices and drives, or any other types of tangible or non-transitory media suitable for storing electronic information. A computer readable signal medium may include mediums such as carrier waves. The algorithms and displays presented herein are not inherently related to any particular computer or other apparatus. Computer programs can involve pure software implementations that involve instructions that perform the operations of the desired implementation.

Various general-purpose systems may be used with programs and modules in accordance with the examples herein, or it may prove convenient to construct a more specialized apparatus to perform desired method steps. In addition, the example implementations are not described with reference to any particular programming language. It will be appreciated that a variety of programming languages may be used to implement the teachings of the example implementations as described herein. The instructions of the programming language(s) may be executed by one or more processing devices, e.g., central processing units (CPUs), processors, or controllers.

As is known in the art, the operations described above can be performed by hardware, software, or some combination of software and hardware. Various aspects of the example implementations may be implemented using circuits and logic devices (hardware), while other aspects may be implemented using instructions stored on a machine-readable medium (software), which if executed by a processor, would cause the processor to perform a method to carry out implementations of the present application. Further, some example implementations of the present application may be performed solely in hardware, whereas other example implementations may be performed solely in software. Moreover, the various functions described can be performed in a single unit, or can be spread across a number of components in any number of ways. When performed by software, the methods may be executed by a processor, such as a general purpose computer, based on instructions stored on a computer-readable medium. If desired, the instructions can be stored on the medium in a compressed and/or encrypted format.

Moreover, other implementations of the present application will be apparent to those skilled in the art from consideration of the specification and practice of the teachings of the present application. Various aspects and/or components of the described example implementations may be used singly or in any combination. It is intended that the specification and example implementations be considered as examples only, with the true scope and spirit of the present application being indicated by the following claims.

What is claimed is:

1. A system, comprising:

a microphone array comprising at least four microphones arranged along locations with respect to each other in a three dimensional shape;

a 360 degree camera configured to provide video feed having a full 360 degree field of view coverage; and a processor, configured to:

for audio received through the microphone array, calculate three dimensional sound intensity between at least two of the at least four microphones of the microphone array, the three dimensional sound representative of intensity amount and direction of the acoustic energy flow from each localized sound source in the audio; and overlay the audio on video feed of the 360 degree camera with the three dimensional sound intensity with respect to a displayed view of the video feed;

wherein the processor is configured to calculate the three dimensional sound intensity between the at least two of the at least four microphones of the microphone array by calculating the three dimensional sound intensity based on an inverse Fourier transform of a cross spectrum of the sound pressure measured by the at least two of the at least four microphones.

2. The system of claim 1, wherein the three dimensional shape is a regular tetrahedron.

3. The system of claim 1, wherein the microphone array is an ambisonics microphone consisting of four microphones.

4. The system of claim 1, wherein the processor is configured to overlay the audio on the video feed of the 360 degree camera with the three dimensional sound intensity with respect to a displayed view of the video feed through a heat map representation of the three dimensional sound intensity on the video feed.

5. A method for a system comprising a microphone array comprising at least four microphones arranged along locations with respect to each other in a three dimensional shape, and a 360 degree camera configured to provide video feed having a full 360 degree field of view coverage; the method comprising:

for audio received through the microphone array, calculating three dimensional sound intensity between at least two of the at least four microphones of the microphone array, the three dimensional sound representative of intensity amount and direction of the acoustic energy flow from each localized sound source in the audio; and overlaying the audio on video feed of the 360 degree camera with the three dimensional sound intensity with respect to a displayed view of the video feed;

wherein the calculating the three dimensional sound intensity between the at least two of the at least four microphones of the microphone array comprises calculating the three dimensional sound intensity based on an inverse Fourier transform of a cross spectrum of the sound pressure measured by the at least two of the at least four microphones.

6. The method of claim 5, wherein the three dimensional shape is a regular tetrahedron.

7. The method of claim 5, wherein the microphone array is an ambisonics microphone consisting of four microphones.

8. The method of claim 5, wherein the overlaying the audio on the video feed of the 360 degree camera with the three dimensional sound intensity with respect to a displayed view of the video feed through a heat map representation of the three dimensional sound intensity on the video feed.

9. A system, comprising:

a microphone array comprising at least four microphones arranged along locations with respect to each other in a three dimensional shape;

a 360 degree camera configured to provide video feed having a full 360 degree field of view coverage; and a processor, configured to:

for audio received through the microphone array, calculate three dimensional sound intensity between at least two of the at least four microphones of the microphone array, the three dimensional sound representative of intensity amount and direction of the acoustic energy flow from each localized sound source in the audio; and overlay the audio on video feed of the 360 degree camera with the three dimensional sound intensity with respect to a displayed view of the video feed;

wherein the processor is configured to calculate the three dimensional sound intensity between the at least two of the at least four microphones of the microphone array by:

calculating a sound pressure of an acoustic center of the microphone array;

deriving a particle velocity between each of the at least four microphones of the microphone array and the acoustic center; and calculating the three dimensional sound intensity from particle velocity calculations along an x, y and z axis based on the derived velocity between the each of the at least four microphones of the microphone array and the acoustic center.

10. The system of claim 9, wherein the three dimensional shape is a regular tetrahedron.

11. The system of claim 9, wherein the microphone array is an ambisonics microphone consisting of four microphones.

12. The system of claim 9, wherein the processor is configured to overlay the audio on the video feed of the 360 degree camera with the three dimensional sound intensity with respect to a displayed view of the video feed through a heat map representation of the three dimensional sound intensity on the video feed.

13. A method for a system comprising a microphone array comprising at least four microphones arranged along locations with respect to each other in a three dimensional shape, and a 360 degree camera configured to provide video feed having a full 360 degree field of view coverage; the method comprising:

for audio received through the microphone array, calculating three dimensional sound intensity between at least two of the at least four microphones of the microphone array, the three dimensional sound representative of intensity amount and direction of the acoustic energy flow from each localized sound source in the audio; and overlaying the audio on video feed of the 360 degree camera with the three dimensional sound intensity with respect to a displayed view of the video feed;

wherein the calculating the three dimensional sound intensity between the at least two of the at least four microphones of the microphone array comprises:

calculating a sound pressure of an acoustic center of the microphone array;

deriving a particle velocity between each of the at least four microphones of the microphone array and the acoustic center; and calculating the three dimensional sound intensity from particle velocity calculations along an x, y and z axis based on the derived velocity between the each of the at least four microphones of the microphone array and the acoustic center.

14. The method of claim 13, wherein the three dimensional shape is a regular tetrahedron.

15. The method of claim 13, wherein the microphone array is an ambisonics microphone consisting of four microphones.

* * * * *